US006225039B1

(12) United States Patent
Eichorst et al.

(10) Patent No.: US 6,225,039 B1
(45) Date of Patent: May 1, 2001

(54) IMAGING ELEMENT CONTAINING AN ELECTRICALLY-CONDUCTIVE LAYER CONTAINING A SULFONATED POLYURETHANE AND A TRANSPARENT MAGNETIC RECORDING LAYER

(75) Inventors: Dennis J. Eichorst, Fairport; Debasis Majumdar; Robert J. Kress, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/172,897

(22) Filed: Oct. 15, 1998

(51) Int. Cl.[7] ..... G03C 1/89

(52) U.S. Cl. ..... 430/529; 430/527; 430/530; 430/531

(58) Field of Search ..... 430/527, 529, 430/530, 531, 533, 140

(56) References Cited

U.S. PATENT DOCUMENTS

| | | | |
|---|---|---|---|
| 3,782,947 | 1/1974 | Krall . | |
| 4,070,189 | 1/1978 | Kelley et al. | 96/87 A |
| 4,203,769 | 5/1980 | Guestaux | 430/631 |
| 4,279,945 | 7/1981 | Audran et al. | 430/140 |
| 4,302,523 | 11/1981 | Audran et al. | 430/140 |
| 4,731,408 | 3/1988 | Jasne | 524/458 |
| 4,987,042 | 1/1991 | Jonas et al. | 429/213 |
| 5,006,451 | 4/1991 | Anderson et al. | 430/527 |
| 5,093,439 | 3/1992 | Epstein et al. | 525/540 |
| 5,147,768 | 9/1992 | Sakakibara | 430/140 |
| 5,217,804 | 6/1993 | James et al. | 428/329 |
| 5,229,259 | 7/1993 | Yokota | 430/140 |
| 5,284,714 | 2/1994 | Anderson et al. | 430/527 |
| 5,294,525 | 3/1994 | Yamauchi et al. | 430/530 |
| 5,300,575 | 4/1994 | Jonas et al. | 525/186 |
| 5,312,681 | 5/1994 | Muys et al. | 428/323 |
| 5,336,589 | 8/1994 | Mukunoki et al. | 430/501 |
| 5,354,613 | 10/1994 | Quintens et al. | 428/341 |
| 5,360,706 | 11/1994 | Anderson et al. | 430/529 |
| 5,366,855 | 11/1994 | Anderson et al. | 430/529 |
| 5,370,981 | 12/1994 | Krafft et al. | 430/529 |
| 5,372,924 | 12/1994 | Quintens et al. | 430/527 |
| 5,380,584 | 1/1995 | Anderson et al. | 428/323 |
| 5,382,494 | 1/1995 | Kudo et al. | 430/140 |
| 5,391,472 | 2/1995 | Muys et al. | 430/527 |
| 5,395,743 | 3/1995 | Brick et al. | 430/496 |
| 5,403,467 | 4/1995 | Jonas et al. | 528/186 |
| 5,413,900 | 5/1995 | Yokota | 430/495 |
| 5,427,835 | 6/1995 | Morrison et al. | 430/527 |
| 5,427,900 | 6/1995 | James et al. | 430/496 |
| 5,432,050 | 7/1995 | James et al. | 430/496 |
| 5,439,785 | 8/1995 | Boston et al. | 430/530 |
| 5,443,944 | 8/1995 | Krafft et al. | 430/529 |
| 5,457,013 | 10/1995 | Christian et al. | 430/496 |
| 5,459,021 | 10/1995 | Ito et al. | 430/527 |
| 5,484,694 | 1/1996 | Lelental et al. | 430/530 |
| 5,498,512 | 3/1996 | James et al. | 430/496 |
| 5,514,528 | 5/1996 | Chen et al. | 430/530 |
| 5,575,898 | 11/1996 | Wolf et al. | 205/125 |
| 5,576,163 | 11/1996 | Anderson et al. | 430/529 |
| 5,665,498 | 9/1997 | Savage et al. | 430/529 |
| 5,674,654 | 10/1997 | Zumbulyadis et al. | 430/41 |
| 5,695,920 * | 12/1997 | Anderson et al. | 430/531 |
| 5,707,791 | 1/1998 | Ito et al. | 430/527 |
| 5,709,984 | 1/1998 | Chen et al. | 430/527 |
| 5,716,550 | 2/1998 | Gardner et al. | 252/500 |
| 5,718,995 | 2/1998 | Eichorst et al. | 430/527 |
| 5,726,001 | 3/1998 | Eichorst | 430/527 |
| 5,731,119 | 3/1998 | Eichorst et al. | 430/529 |
| 5,866,287 * | 2/1999 | Christian et al. . | |

FOREIGN PATENT DOCUMENTS

| | | |
|---|---|---|
| 4062543 | 12/1990 | (JP) . |
| 6161033 | 9/1994 | (JP) . |
| 7159912 | 6/1995 | (JP) . |
| 7168293 | 7/1995 | (JP) . |

* cited by examiner

*Primary Examiner*—Richard L. Schilling
(74) *Attorney, Agent, or Firm*—Doreen M. Wells

(57) ABSTRACT

The present invention is an imaging element which includes a support, an image-forming layer superposed on the support, a transparent magnetic recording layer superposed on the support and an electrically-conductive layer superposed on the support. The electrically-conductive layer is composed of a sulfonated polyurethane film-forming binder and an electrically-conductive agent.

13 Claims, No Drawings

IMAGING ELEMENT CONTAINING AN ELECTRICALLY-CONDUCTIVE LAYER CONTAINING A SULFONATED POLYURETHANE AND A TRANSPARENT MAGNETIC RECORDING LAYER

CROSS REFERENCE TO RELATED APPLICATIONS

This application relates to commonly assigned copending application Ser. No. 09/172,901, filed simultaneously herewith. This application relates to commonly assigned copending application Ser. No. 09/173,439, filed simultaneously herewith. This application relates to commonly assigned copending application Ser. No. 09/172,878, filed simultaneously herewith.

FIELD OF THE INVENTION

This invention relates generally to imaging elements including a support, one or more image-forming layers, a transparent, magnetic recording layer and one or more transparent, electrically-conductive layers. More specifically, this invention relates to photographic and thermally-processable imaging elements having one or more sensitized silver halide emulsion layers, a transparent, magnetic recording layer and one or more electrically-conductive layers, the conductive layers having an electrically conductive agent dispersed in a sulfonated polyurethane film-forming binder.

BACKGROUND OF THE INVENTION

It is well known to include in various kinds of imaging elements, a transparent layer containing magnetic particles dispersed in a polymeric binder. The inclusion and use of such transparent magnetic recording layers in light-sensitive silver halide photographic elements has been described in U.S. Pat. Nos. 3,782,947; 4,279,945; 4,302,523; 5,217,804; 5,229,259; 5,395,743; 5,413,900; 5,427,900; 5,498,512; and others. Such elements are advantageous because images can be recorded by customary photographic processes while information can be recorded simultaneously into or read from the magnetic recording layer by techniques similar to those employed for traditional magnetic recording art.

A difficulty, however, arises in that magnetic recording layers generally employed by the magnetic recording industry are opaque, not only because of the nature of the magnetic particles, but also because of the requirements that these layers contain other addenda which further influence the optical properties of the layer. Also, the requirements for recording and reading of the magnetic signal from a transparent magnetic layer are more stringent than for conventional magnetic recording media because of the extremely low coverage of magnetic particles required to ensure transparency of the transparent magnetic layer as well as the fundamental nature of the photographic element itself. Further, the presence of the magnetic recording layer cannot interfere with the function of the photographic imaging element.

The transparent magnetic recording layer must be capable of accurate recording and playback of digitally encoded information repeatedly on demand by various devices such as a camera or a photofinishing or printing apparatus. The layer also must exhibit excellent running, durability (i.e., abrasion and scratch resistance), and magnetic head-cleaning properties without adversely affecting the imaging quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic elements. These goals are particularly difficult to achieve when magnetically recorded information is stored and read from the photographic image area. Further, because of the curl of the photographic element, primarily due to the photographic layers and the core set of the support, the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the generation and discharge of electrostatic charge during the manufacture and use of photographic film and paper have been recognized for many years by the photographic industry. The accumulation of charge on film or paper surfaces leads to the attraction of dust, which can produce physical defects. The discharge of accumulated charge during or after the application of the sensitized emulsion layers can produce irregular fog patterns or static marks in the emulsion. The severity of the static problems has been exacerbated greatly by the increases in sensitivity of new emulsions, increases in coating machine speeds, and increases in post-coating drying efficiency. The charge generated during the coating process results primarily from the tendency of webs of high dielectric constant polymeric film base to undergo triboelectric charging during winding and unwinding operations, during conveyance through the coating machines, and during post-coating operations such as slitting, perforating, and spooling. Static charge can also be generated during the use of the finished photographic product. For example, in an automatic camera, because of the repeated motion of the photographic film in and out of the film cassette, there is the added problem of the generation of electrostatic charge by the movement of the film across the magnetic heads and by the repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance (e.g., S/N ratio, "drop-outs", etc.). This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. In order to prevent these problems arising from electrostatic charging, there are various well known methods by which an electrically-conductive layer can be introduced into the photographic element to dissipate any accumulated electrostatic charge.

Antistatic layers containing electrically-conductive agents can be applied to one or both sides of the film base as subbing layers either beneath or on the side opposite to the silver halide emulsion layers. An antistatic layer also can be applied as an outer layer coated either over the emulsion layers or on the side opposite to the emulsion layers or on both sides of the film base. For some applications, it may be advantageous to incorporate the antistatic agent directly into the film base or to introduce it into a silver halide emulsion layer. Typically, in photographic elements of prior art comprising a transparent magnetic recording layer, the antistatic layer was preferably present as a backing layer underlying the magnetic recording layer.

The use of such electrically-conductive layers containing suitable semi-conductive metal oxide particles dispersed in a film-forming binder in combination with a transparent magnetic recording layer in silver halide imaging elements has been described in the following examples of the prior art. Photographic elements including a transparent magnetic recording layer and a transparent electrically-conductive layer both located on the backside of the film base have been described in U.S. Pat. Nos. 5,147,768; 5,229,259; 5,294,525; 5,336,589; 5,382,494; 5,413,900; 5,457,013; 5,459,021; and others. The conductive layers described in these patents contain fine granular particles of a semi-conductive crystalline metal oxide such as zinc oxide, titania, tin oxide, alumina, indium oxide, silica, complex or compound oxides thereof, and zinc antimonate or indium antimonate dispersed in a polymeric film-forming binder. Of these conductive metal oxides, antimony-doped tin oxide and zinc antimonate are preferred. A granular, antimony-doped tin oxide particle commercially available from Ishihara Sangyo Kaisha under the tradename "SN-100P" was disclosed as particularly preferred in Japanese Kokai Nos. 04-062543, 06-161033, and 07-168293.

The preferred average diameter for granular conductive metal oxide particles was disclosed as less than 0.5 $\mu$m in U.S. Pat. No. 5,294,525; 0.02 to 0.5 $\mu$m in U.S. Pat. No. 5,382,494; 0.01 to 0.1 $\mu$m in U.S. Pat. Nos. 5,459,021 and 5,457,013; and 0.01 to 0.05 $\mu$m in U.S. Pat. No. 5,457,013. Suitable conductive metal oxide particles exhibit specific volume resistivities of $1\times10^{10}$ ohm.cm or less, preferably $1\times10^{7}$ ohm.cm or less, and more preferably $1\times10^{5}$ ohm.cm or less as taught in U.S. Pat. No. 5,459,021. Another physical property used to characterize crystalline metal oxide particles is the average x-ray crystallite size. The concept of crystallite size is described in detail in U.S. Pat. No. 5,484,694 and references cited therein. Transparent conductive layers containing semiconductive antimony-doped tin oxide granular particles exhibiting a preferred crystallite size of less than 10 nm are taught in U.S. Pat. No. 5,484,694 to be particularly useful in imaging elements. Similarly, photographic elements comprising transparent magnetic layers in combination with conductive layers containing granular conductive metal oxide particle with average crystallite sizes ranging from 1 to 20 nm, preferably 1 to 5 nm, and more preferably from 1 to 3.5 nm are claimed in U.S. Pat. No. 5,459,021. Advantages to using metal oxide particles with small crystallite sizes are disclosed in U.S. Pat. Nos. 5,484,694 and 5,459,021 including the ability to be milled to a very small size without significant degradation of electrical performance, ability to produce a specified level of conductivity at lower weight loadings and/or dry coverages, as well as decreased optical density, decreased brittleness, and decreased cracking of conductive layers containing such particles.

Conductive layers containing such metal oxide particles have been applied at the following preferred ranges of dry weight coverages of metal oxide: 3.5 to 10 g/m$^2$; 0.1 to 10 g/m$^2$; 0.002 to 1 g/m$^2$; 0.05 to 0.4 g/m$^2$ as disclosed in U.S. Pat. Nos. 5,382,494; 5,457,013; 5,459,021; and 5,294,525, respectively. Preferred ranges for the metal oxide fraction in the conductive layer include: 17 to 67 weight percent, 43 to 87.5 weight percent, and 30 to 40 volume percent as disclosed in U.S. Pat. Nos. 5,294,525; 5,382,494; and 5,459,021, respectively. Surface electrical resistivity (SER) values were reported in U.S. Pat. No. 5,382,494 for conductive layers measured prior to overcoating with a transparent magnetic layer as ranging from $10^5$ to $10^7$ ohm/square and from $10^6$ to $10^8$ ohm/square after overcoating. Surface resistivity values of about $10^8$ to $10^{11}$ ohm/square for conductive layers overcoated with a transparent magnetic layer were reported in U.S. Pat. Nos. 5,457,013 and 5,459,021.

In addition to the antistatic layer being present as a backing or subbing layer, the inclusion of conductive tin oxide granular particles with an average diameter less than 0.15 $\mu$m in a transparent magnetic recording layer with cellulose acetate binder is disclosed in U.S. Pat. Nos. 5,147,768; 5,427,900 and Japanese Kokai No. 07-159912. For a tin oxide fraction of about 92 weight percent, the surface resistivity of the conductive layer is reported to be approximately $1\times10^{11}$ ohm/square in U.S. Pat. No. 5,427,900.

Photographic elements including an electrically-conductive layer containing colloidal "amorphous" silver-doped vanadium pentoxide and a transparent magnetic recording layer have been disclosed in U.S. Pat. Nos. 5,395,743; 5,427,900; 5,432,050; 5,498,512; 5,514,528 and others. Colloidal vanadium oxide is composed of entangled conductive microscopic fibrils or ribbons that are 0.005–0.01 $\mu$m wide, about 0.001 $\mu$m thick, and 0.1–1 $\mu$m in length. Conductive layers containing colloidal vanadium pentoxide prepared as described in U.S. Pat. No. 4,203,769 can exhibit low surface resistivities at very low weight fractions and dry weight coverages of vanadium oxide, low optical losses, and excellent adhesion of the conductive layer to film supports. However, colloidal vanadium pentoxide readily dissolves at high pH in developer solution during wet processing and must be protected by a nonpermeable, overlying barrier layer. Examples of suitable barrier layers are taught in U.S. Pat. Nos. 5,006,451; 5,284,714; and 5,366,855. Further, when a conductive layer containing colloidal vanadium pentoxide underlies a transparent magnetic layer, the magnetic layer inherently can serve as a nonpermeable barrier layer. However, if the magnetic layer contains a high level of reinforcing filler particles, such as gamma aluminum oxide or silica fine particles, it must be crosslinked using suitable cross-linking agents in order to preserve the desired barrier properties, as taught in U.S. Pat. No. 5,432,050.

Alternatively, a film-forming sulfopolyester latex or polyesterionomer binder can be combined with the colloidal vanadium pentoxide in the conductive layer to minimize degradation during processing as taught in U.S. Pat. Nos. 5,360,706; 5,380,584; 5,427,835; 5,576,163; and others. Furthermore, it is disclosed that the use of a polyesterionomer can improve solution stability of colloidal vanadium pentoxide containing dispersions. Instability of vanadium pentoxide gels in the presence of various binders is well known and several specific classes of polymeric binders have been identified for improved stability or coatability, for example in U.S. Pat. Nos. 5,427,835; 5,439,785; 5,360,706; and 5,709,984. U.S. Pat. No. 5,427,835 teaches the use of sulfopolymers in combinations with vanadium oxide preferably prepared from hydrolysis of oxoalkoxides for antistatic applications. A specific advantage cited for preparation of vanadium oxide gels from oxoalkoxides is the ability to control the vanadium oxidation state. Colloidal vanadium oxide gels are described as viscous dark brown solutions which become homogeneous upon aging. Comparative Example 3 describes the formation of "dark greenish clots" upon mixing with polyacrylic acid indicating a change in oxidation state and flocculation of the gel. Similarly, the examples of sulfopolymers with vanadium oxide result in a color change from dark brown to dark greenish-brown, again indicating a potentially undesirable change in vanadium oxidation state. Sulfopolymers indicated to be useful include sulfopolyester, ethylenically-unsaturated sulfolpolymers, sulfopolyurethanes, sulfopolyurethane/-polyureas, sulfopolyester polyols, sulfopolyols, sulfonate containing polymers such as poly(sodiumstyrene sulfonate) and alkylene oxide-co-sulfonate containing polyesters. However, as indicated hereinbelow by comparative examples, not all of the above sulfopolymers provide adequate adhesion when overcoated with a transparent magnetic recording layer.

U.S. Pat. No. 5,439,785 teaches the use of a specified ratio of sulfopolymer to vanadium oxide to provide an antistatic formulation which remains conductive after photographic processing. A range of from 1:20 to 1:150 $V_2O_5$:sulfopolymer is specified. Surface electrical resistivity values are typically greater than $1\times10^9$ ohm/square for the indicated range. At lower colloidal vanadium oxide levels, the conductivity is insufficient to provide antistatic protection; at higher vanadium oxide levels the antistatic layer loses conductivity when subjected to photographic processing. However, prior art colloidal vanadium pentoxide typically have significantly lower resistivity values, i.e., $1\times10^8$ ohm/square. Consequently, one of the primary benefits of colloidal vanadium oxide, low resistivity at low dry weight coverage is not achieved.

Colloidal vanadium oxide dispersed with a terpolymer of vinylidene chloride, acrylonitrile, and acrylic acid coated on subbed polyester supports and overcoated with a transparent magnetic recording layer is taught in U.S. Pat. Nos. 5,432,050 and 5,514,528. U.S. Pat. No. 5,514,528 also teaches an antistatic layer consisting of colloidal vanadium oxide and an aqueous dispersible polyester coated on a subbed polyester support and subsequently overcoated with a transparent magnetic recording layer.

U.S. Pat. No. 5,718,995 teaches an antistatic layer containing an electrically-conductive agent and a specified polyurethane binder having excellent adhesion to surface treated or subbed polyester supports and to an overlying transparent magnetic layer. The specified polyurethane is an aliphatic, anionic polyurethane having an ultimate elongation to break of at least 350 percent, however, sulfonated polyurethanes are neither taught nor claimed. Comparative Example 1 of '995 demonstrates that it is difficult to achieve adequate adhesion to glow discharge treated polyethylene naphthalate for a magnetics backing package consisting of a solvent coated cellulosic-based magnetic layer and an antistatic layer containing colloidal vanadium pentoxide and either a sulfopolyester or interpolymer of vinylidene chloride cited as preferred binders in the above mentioned U.S. patents. It was further demonstrated in Comparative Examples 9–13 that electrically-conductive layers composed of a non-preferred polyurethane binder also did not provide adequate adhesion. Electrically-conductive agents taught for use in combination with the specified polyurethane binder included tin oxide, colloidal vanadium oxide, zinc antimonate, indium antimonate and carbon fibers. It was further disclosed that electrically-conductive polymers as exemplified by polyanilines and polythiophenes may also be used. However, it was indicated that a coating composition consisting of the specified polyurethane binder and colloidal vanadium oxide had limited shelf-life (less then 48 hrs). As indicated by Comparative Examples of the present invention, solution stability is also unacceptable for a coating composition consisting of an electrically-conductive polypyrrole and Witcobond W-236 (commercially available from Witco Corporation) a preferred polyurethane disclosed in '995. Comparative Examples shown herein demonstrate unacceptable solution stability for electrically-conductive layers containing a non-sulfonated polyurethane binder and either polypyrrole or colloidal vanadium oxide.

U.S. Pat. No. 5,726,001 teaches an adhesion promoting polyurethane layer coated either above or below an electrically-conductive layer which can improve adhesion for an overlying transparent magnetic recording layer. Without, the addition of the adhesion promoting layer, a magnetic backing package containing an electrically-conductive layer consisting of an anionic aliphatic polyurethane having an ultimate elongation to break of at least 350 percent and colloidal vanadium oxide at either a 1/1 or 4/1 weight ratio was demonstrated to have unacceptable adhesion. Consequently, an increase in the binder/vanadium oxide ratio is required which typically results in reduced conductivity and solution stability. The use of an additional layer for improved adhesion is undesirable due to increased coating complexity.

The use of crystalline, single-phase, acicular, conductive metal-containing particles in transparent conductive layers for various types of imaging elements also containing a transparent magnetic recording layer has been disclosed in U.S. Pat. No. 5,731,119 incorporated herein by reference with regards to suitable acicular particles for use in various imaging elements containing a transparent magnetic recording layer. Suitable acicular, conductive metal-containing particles have a cross-sectional diameter $\leqq 0.02$ $\mu$m and an aspect ratio (length to cross-sectional diameter) $\geqq 5:1$. Preferred acicular, conductive metal-containing particles have an aspect ratio $\geqq 10:1$.

Electrically-conducting polymers have recently received attention from various industries because of their electronic conductivity. Although many of these polymers are highly colored and are less suited for photographic applications, some of these electrically conducting polymers, such as substituted or unsubstituted pyrrole-containing polymers (as disclosed in U.S. Pat. Nos. 5,665,498 and 5,674,654), substituted or unsubstituted thiophene-containing polymers (as disclosed in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as disclosed in U.S. Pat. Nos. 5,716,550; 5,093,439 and 4,070,189) are transparent and not prohibitively colored, at least when coated in thin layers at moderate coverage. Because of their electronic conductivity instead of ionic conductivity, these polymers are conducting even at low humidity. Moreover, these polymers can retain sufficient conductivity even after wet chemical processing to provide what is known in the art as "process-surviving" antistatic characteristics to the photographic support they are applied to.

The use of electronically-conductive polythiophenes in an electrically-conductive layer either below or above a transparent magnetic layer is taught is U.S. Pat. No. 5,443,944. Suitable polythiophenes are prepared by oxidative polymerization of thiophene in the presence of polymeric carboxylic acids or polymeric sulfonic acids. Examples of polythiophene-containing antistatic layers either had no polymeric film-forming binder, a vinylidene chloride based terpolymer, or a polyurethane. The polyurethane binder was indicated to give "insufficient antistatic effects."

An electrically-conductive layer containing poly(3,4-ethylene dioxypyrrole/styrene sulfonate) in a film-forming binder used in combination with a transparent magnetic layer is claimed in U.S. Pat. No. 5,665,498. Similarly, an electrically-conductive layer containing polypyrrole/poly (styrene sulfonic acid) used in combination with a transparent magnetic layer is disclosed in U.S. Pat. No. 5,674,654. Suitable film-forming binders are indicated to include aqueous dispersions of polyurethanes or polyesterionomers. However, neither polyurethane film-forming binders nor a transparent recording layer overlying the electrically-conductive layer are taught. Sulfonated polyester binders as taught in '498 and '654 have resulted in insufficient adhesion to an overlying magnetic layer.

U.S. Pat. No. 5,707,791 claims a silver halide element having a resin layer consisting of an antistatic agent and an aqueous-dispersible polyester resin or an aqueous-dispersible polyurethane resin, and magnetic layer coated on the resin layer. The antistatic agent is selected from the group consisting of a conductive polymer and a metal oxide. Suitable methods of making the polyurethane water dispersible are disclosed to include introducing a carboxyl group, sulfon group or tertiatry amino group into the polyurethane. Furthermore, the conductive polymers indicated are preferably anionic or cationic ionically-conducting polymers. Electronically-conducting polymers such as polythiophenes, polyanilines, or polypyrroles are not indicated.

U.S. Pat. No. 5,382,494 claims a silver halide photographic material having a magnetic recording layer on a backing layer. The backing layer contains inorganic particles of a metal oxide which have at least one surface being water-insoluble, and dispersed in a binder in a proportion of 75.0% to 660% by weight of the binder. Suitable binders include a polyester polyurethane resin, polyether polyurethane resin, polycarbonate polyurethane resin and a polyester resin. It is further disclosed that "the backing layer is allowed to contain an organic particles in place of the inorganic particles."

U.S. Pat. No. 5,294,525 discloses a silver halide photographic material containing a transparent magnetic layer, a conductive layer containing conductive particles and a binder. The binder contains a polar functional group consisting of $—SO_2M$, $—OSO_3M$ and $—P(=O)(OM_1)(OM_2)$ wherein M is hydrogen, sodium, potassium, or lithium; $M_1$ and $M_2$ are the same or different and represent hydrogen, sodium, potassium, lithium, or an alkyl group. Suitable binder resins include polyvinyl chloride resins, polyurethane resins, polyester resins and polyethylene type resins. However, '525 additionally requires the binder for the magnetic layer contain a polar functional group indicated above. The required addition of a polar functional group in the binder of the magnetic layer is undesirable for the physical and chemical properties of the magnetic layer. Furthermore, increased permeability of the magnetic binder can potentially result in chemical change of the magnetic particles and consequently alter the desired magnetic signal.

Because the requirements for an electrically-conductive layer to be useful in an imaging element are extremely demanding, the art has long sought to develop improved conductive layers exhibiting a balance of the necessary chemical, physical, optical, and electrical properties. As indicated hereinabove, the prior art for providing electrically-conductive layers useful for imaging elements is extensive and a wide variety of suitable electroconductive materials have been disclosed. However, there is still a critical need in the art for improved conductive layers which can be used in a wide variety of imaging elements, which can be manufactured at a reasonable cost, which are resistant to the effects of humidity change, which are durable and abrasion-resistant, which do not exhibit adverse sensitometric or photographic effects, which exhibit acceptable adhesion to overlying or underlying layers, which exhibit suitable cohesion, and which are substantially insoluble in solutions with which the imaging element comes in contact, such as processing solutions used for photographic elements. Further, to provide both effective magnetic recording properties and effective electrical-conductivity for an imaging element, without impairing its imaging characteristics, poses a considerably greater technical challenge.

It is toward the objective of providing a useful combination of a transparent magnetic recording layer and an electrically-conductive layer which can be comprised of a wide variety of electrically-conductive agents and have acceptable adhesion to underlying and overlying layers that more effectively meet the diverse needs of imaging elements, especially those of silver halide photographic films, but also of a wide variety of other types of imaging elements than those of the prior art that the present invention is directed.

SUMMARY OF THE INVENTION

The present invention is an imaging element which includes a support, an image-forming layer superposed on the support, a transparent magnetic recording layer superposed on the support, and an electrically-conductive layer superposed on the support. The electrically-conductive layer includes a sulfonated polyurethane film-forming binder and electrically-conductive agents.

DETAILED DESCRIPTION OF THE INVENTION

The present invention provides an imaging element for use in an image-forming process including a support, at least one imaging layer, a transparent magnetic recording layer, and at least one electrically-conductive layer, wherein the electrically-conductive layer contains electrically conductive agents dispersed in a sulfonated polyurethane film-forming binder. The specified polyurethane binder provides improved adhesion to underlying and overlying layers, particularly to subbed or surface treated polyester supports and to an overlying transparent magnetic recording layer. In addition, the sulfonated polyurethane has excellent solution stability or compatibility with a vast array of electrically-conductive agents, particularly with electrically-conductive polymers and colloidal vanadium oxide, relative to non-sulfonated polyurethanes of prior art. Furthermore, internal resistivity of electrically conductive layers containing a sulfonated polyurethane and an electrically conductive polymer when overcoated with a transparent magnetic recording layer is significantly lower than similar layers containing a non-sulfonated polyurethane binder. One consequence of improved conductivity is less electrically conductive agent can be used resulting in further adhesion improvements and increased optical transparency.

Imaging elements including a transparent magnetic recording layer are described, for example, in U.S. Pat. Nos. 3,782,947; 4,279,945; 4,302,523; 4,990,276; 5,215,874; 5,217,804; 5,252,441; 5,254,449; 5,335,589; 5,395,743; 5,413,900; 5,427,900 and others; in European Patent Application No. 0 459,349 and in Research Disclosure, Item No. 34390 (November, 1992). Such elements are advantageous because they can be employed to record images by the customary photographic process while at the same time additional information can be recorded on and read from the magnetic layer by techniques similar to those employed in the magnetic recording art. A transparent magnetic layer can be positioned in an imaging element in any of various positions. For example, it can overlie one or more image-forming layers, underlie one or more image-forming layers, be interposed between image-forming layers, serve as a subbing layer for an image-forming layer, be coated on the side of the support opposite an image-forming layer or can be incorporated into an image-forming layer.

Conductive layers in accordance with this invention are broadly applicable to photographic, thermographic, electrothermographic, photothermographic, dielectric recording, dye migration, laser dye-ablation, thermal dye transfer, electrostatographic, electrophotographic imaging elements, and others. Details with respect to the composition and function of this wide variety of imaging elements are provided in U.S. Pat. Nos. 5,719,016 and 5,731,119. Conductive layers of this invention may be present as a backing, subbing, intermediate or protective overcoat layer on either or both sides of the support. Further, the conductive properties of many of the potential electrically-conductive agents are essentially independent of relative humidity and persist even after exposure to aqueous solutions having a wide range of pH values (e.g., $2 \leqq pH \leqq 13$) encountered in the wet-processing of silver halide photographic films. Thus, it is not generally necessary to provide a protective overcoat overlying the conductive layer of this invention, although optional protective layers may be present in the imaging element.

The electrically conductive layer of the present invention comprises an electrically conductive agent dispersed with a sulfonated polyurethane film forming binder, and can be coated out of an aqueous system on a suitable imaging support. The electrically conductive agent can be chosen from any or a combination of electrically-conductive particles, , electrically-conductive "amorphous" gels, carbon nanofibers, electronically-conductive polymers, or conductive clays.

Electrically-conductive granular particles in the electrically conductive layer of the present invention may be composed of conductive crystalline inorganic oxides, conductive metal antimonates, or conductive inorganic non-oxides. Crystalline inorganic oxides may be chosen from ZnO, $TiO_2$, $SnO_2$, $Al_2O_3$, $In_2O_3$, $SiO_2$, MgO, BaO, $MoO_3$, $WO_3$, $V_2O_5$, $HfO_2$, $ThO_2$, $ZrO_2$ and $CeO_2$ or composite oxides thereof. Additional conductive metal oxides include an excess-oxygen oxide such as $Nb_2O_{5+x}$, an oxygen deficiency oxide such as $RhO_{2-x}$, and $Ir2O_{3-x}$, or a non-stoichiometeric oxide such as $Ni(OH)_x$. The conductive crystalline inorganic oxides may contain a "dopant" in the range from 0.01 to 30 mole percent, preferred dopants being Al or In for ZnO; Nb or Ta for $TiO_2$; and Sb, Nb or halogens for $SnO_2$. Alternatively, conductivity can be enhanced by formation of oxygen defects by methods well known in the art. Preferred conductive crystalline inorganic oxides are antimony-doped tin oxide, aluminum-doped zinc oxide and niobium-doped titania. A particularly preferred crystalline inorganic oxide is antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694.

Conductive metal antimonates which may be used in the present invention have a rutile or rutile-related crystallographic structure and may be represented as $M^{+2}Sb^{+5}{}_2O_6$ (where $M^{+2}$=$Zn^{+2}$, $Ni^{+2}$, $Mg^{+2}$, $Fe^{+2}$, $Cu^{+2}$, $Mn^{+2}$, $Co^{+2}$) or $M^{+3}Sb^{+5}O_4$ (where $M^{+3}$=$In^{+3}$, $Al^{+3}$, $Sc^{+3}$, $Cr^{+3}$, $Fe^{+3}$). Several colloidal conductive metal antimonate dispersions are commercially available from Nissan Chemical Company in the form of aqueous or organic dispersions. Alternatively, U.S. Pat. Nos. 4,169,104 and 4,110,247 teach a method for preparing $M^{+2}Sb^{+5}{}_2O_6$ by treating an aqueous solution of potassium antimonate with an aqueous solution of an appropriate metal salt (e.g., chloride, nitrate, sulfate, etc.) to form a gelatinous precipitate of the corresponding insoluble hydrate which may be converted to a conductive metal antimonate by suitable treatment. Suitable particle size for metal antimonate particles is less than about 0.2 $\mu$m and more preferably less than about 0.1 $\mu$m.

Conductive inorganic non-oxides suitable as conductive particles in the present invention include: TiN, $TiB_2$, TiC, $NbB_2$, WC, $LaB_6$, $ZrB_2$, MoB, and the like, as described in Japanese Kokai No. 4/55492, published Feb. 24, 1992.

The conductive particles present in the antistatic layer are not specifically limited in particle size or shape. The particle shape may range from roughly spherical or equiaxed particles to high aspect ratio particles such as fibers, whiskers or ribbons. Additionally, the conductive materials described above may be coated on a variety of other particles, also not particularly limited in shape or composition. For example the conductive inorganic material may be coated on non-conductive $SiO_2$, $Al_2O_3$ or $TiO_2$ particles, whiskers or fibers.

Electrically-conductive metal-containing acicular particles used in accordance with this invention are preferably single-phase, crystalline, and have nanometer-size dimensions. Suitable dimensions for the acicular conductive particles are less than 0.05 $\mu$m in cross-sectional diameter (minor axis) and less than 1 $\mu$m in length (major axis), preferably less than 0.02 $\mu$m in cross-sectional diameter and less than 0.5 $\mu$m in length, and more preferably less than 0.01 $\mu$m in cross-sectional diameter and less than 0.15 $\mu$m in length. These dimensions tend to minimize optical losses of coated layers containing such particles due to Mie-type scattering by the particles. A mean aspect ratio (major/minor axes) of at least 3:1 is suitable; a mean aspect ratio of greater than or equal to 5:1 is preferred; and a mean aspect ratio of greater than or equal to 10:1 is more preferred for acicular conductive metal-containing particles in accordance with this invention.

One particularly useful class of acicular, electronically-conductive, metal-containing particles comprises acicular, semiconductive metal oxide particles. Acicular, semiconductive metal oxide particles suitable for use in the conductive layers of this invention exhibit a specific (volume) resistivity of less than $1\times10^4$ ohm.cm, more preferably less than $1\times10^2$ ohm.cm. One example of such a preferred acicular semiconductive metal oxide is the acicular electroconductive tin oxide described in U.S. Pat. No. 5,575,957 which is available under the tradename "FS-10P" from Ishihara Techno Corporation. Said electroconductive tin oxide comprises acicular particles of single-phase, crystalline tin oxide doped with about 0.3–5 atom percent antimony as a solid solution. The mean dimensions of the acicular tin oxide particles determined by image analysis of transmission electron micrographs are approximately 0.01 $\mu$m in cross-sectional diameter and 0.1 $\mu$m in length with a mean aspect ratio of about 10:1. Other suitable acicular electroconductive metal oxides include, for example, a tin-doped indium sesquioxide similar to that described in U.S. Pat. No.

5,580,496, but with a smaller mean cross-sectional diameter, aluminum-doped zinc oxide, niobium-doped titanium dioxide, an oxygen-deficient titanium suboxide, $TiO_x$, where x<2 and a titanium oxynitride, $TiO_xN_y$, where $(x+y)\leqq 2$, similar to those phases described in U.S. Pat. No. 5,320,782. Additional examples of other non-oxide, acicular, electrically-conductive, metal-containing particles include selected fine particle metal carbides, nitrides, silicides, and borides prepared by various methods.

The conductive agent may alternatively be a conductive "amorphous" gel such as colloidal vanadium oxide gel comprised of vanadium oxide ribbons or fibers prepared by any variety of methods, including but not specifically limited to melt quenching as described in U.S. Pat. No. 4,203,769, ion exchange as described in DE 4,125,758, or hydrolysis of a vanadium oxoalkoxide as claimed in WO 93/24584. Colloidal vanadium pentoxide is typically composed of highly entangled microscopic fibrils or ribbons 0.005–0.01 μm wide, about 0.001 μm thick, and 0.1–1 μm in length. Conductivity of vanadium oxide gel may be enhanced by controlling the vanadium oxidation state. One method of controlling the vanadium oxidation state is doping, particularly with transition metal elements, most preferably with silver. Another method of controlling the vanadium oxidation state is the use of both $V^{+4}$ and $V^{+5}$ components, for example during the hydrolysis of vanadium oxoalkoxides. Other methods of preparing vanadium oxide gels which are well known in the literature include reaction of vanadium or vanadium pentoxide with hydrogen peroxide and hydrolysis of $VO_2OAc$ or vanadium oxychloride. Preferred methods of preparing vanadium oxide gels are melt-quenching and hydrolysis of vanadium oxoalkoxides. The vanadium oxide gel may contain a dopant or be intercalated with a water-soluble vinyl containing polymer as disclosed in U.S. Ser. No. 09/161,881(Docket 78431AJA) filed Sep. 28, 1998 incorporated herein by reference.

Other suitable electrically-conductive materials include carbon fibers or filaments as taught in U.S. Pat. No. 5,576,162. Recently there have been several commercial sources of carbon filaments or fibers including Applied Sciences, Inc., Cedarville, Ohio, under license from GM; Hyperion Catalysis International, and others. Alternatively, carbon filaments suitable for antistatic applications may be prepared by a variety of methods including pyrolysis of polymeric fibers such as polyacrylonitrile, and vapor phase growth or seeded vapor phase growth. The preferred method is vapor phase growth using metal catalyst seed particles which initiate fiber growth and act as a diffusion transport medium. In this process hollow fibers are typically produced in which the outer fiber diameter can be controlled by the size of the catalyst particle. Suitable fiber diameters are less than 0.3 μm, preferred fiber diameters are 0.2 μm or smaller, and preferably 0.1 μm or smaller.

Suitable electrically conductive polymers are specifically electronically conduducting polymers having acceptable coloration include substituted or unsubstituted aniline-containing polymers (as disclosed in U.S. Pat. Nos. 5,716,550; 5,093,439 and 4,070,189), substituted or unsubstituted thiophene-containing polymers (as disclosed in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408), substituted or unsubstituted pyrrole-containing polymers (as disclosed in U.S. Pat. Nos. 5,665,498 and 5,674,654), and poly(isothianaphthene) or derivatives thereof. The electrically conducting polymer may be soluble or dispersible in organic solvents or water or mixtures thereof. For environmental reasons, aqueous systems are preferred. Polyanions used in the synthesis of these electrically conducting polymers are the anions of polymeric carboxylic acids such as polyacrylic acids, polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on known methods. Instead of the free acids required for the formation of the electrically conducting polymers and polyanions, mixtures of alkali salts of polyacids and appropriate amounts of monoacids may also be used. Preferred electrically conducting polymers for the present invention include polypyrrole styrene sulfonate (referred to as polypyrrole/poly (styrene sulfonic acid) in U.S. Pat. No. 5,674,654), 3,4-dialkoxy substituted polypyrrole styrene sulfonate, and 3,4-dialkoxy substituted polythiophene styrene sulfonate. The most preferred substituted electrically conductive polymers include poly(3,4-ethylene dioxypyrrole styrene sulfonate) and poly(3,4-ethylene dioxythiophene styrene sulfonate).

Conductive clays include natural clays, such as kaolin, bentonite, and especially dispersible or delaminatable smectite clays such as montmorillonite, beidellite, hectorite, and saponite. Synthetic smectite clay materials such as a synthetic layered hydrous magnesium silicate which closely resembles the naturally occurring clay mineral hectorite in both composition and structure are preferred. Hectorite belongs to the class of clays and clay-related minerals known as "swellable" clays and is relatively rare and typically is contaminated with other minerals such as quartz or ionic species which are difficult to remove. A particularly preferred synthetic hectorite which is free from contaminants can be prepared under controlled conditions and is available commercially from Laporte Industries, Ltd. under the tradename "Laponite". The crystallographic structure of this synthetic hectorite can be described as a three-layer hydrous magnesium silicate. The central layer contains magnesium ions octahedrally coordinated by oxygen, hydroxyl or fluoride ions, wherein the magnesium ions can be partially substituted with suitable monovalent ions such as lithium, sodium, potassium, and/or vacancies. This central octahedrally coordinated layer is sandwiched between two other layers containing silicon ions tetrahedrally coordinated by oxygen ions. Individual hectorite clay particles can be readily swollen using deionized water and ultimately exfoliated to provide a stable aqueous dispersion of tiny platelets (smectites) with an average diameter of about 0.025–0.050 μm and an average thickness of about 0.001 μm known as a "sol". In the presence of alkali, alkaline earth or metal ions, electrostatic attractions between the individual platelets can produce various associative structures which exhibit extended ordering.

The preferred sulfonated polyurethane binder is preferably an anionic aliphatic polyurethane dispersion in water. The preparation of polyurethanes in general and, water-dispersible polyurethanes in particular, is well known and described, for example, in U.S. Pat. Nos. 4,307,219; 4,408,008; and 3,998,870. Water-dispersible polyurethanes can be prepared by chain extending a prepolymer containing terminal isocyanate groups with a chain extension agent (an active hydrogen compound, usually a diamine or diol). The prepolymer is formed by reacting a diol or polyol having terminal hydroxyl groups with excess diisocyanate or polyisocyanate. To permit dispersion in water, water-solubilizing/dispersing groups are introduced either into the prepolymer prior to chain extension or are introduced as part of the chain extension agent. For the purpose of the present invention, suitable polyurethanes contain sulfonate groups as the water-solubilizing/dispersing groups. Suitable polyurethanes may also contain a combination of sulfonate groups and nonionic groups such as pendant polyethylene oxide chains as the water-solubilizing/dispersing groups. The sulfonate groups may be introduced by utilizing sulfonate-containing diols or polyols, sulfonate-containing-diisocyanates or polyisocyanates or sulfonate-containing-chain extension agents such as a sulfonate-containing diamines in the preparation of the water-dispersible polyurethane.

Use of sulfonated polyesters in combination with polythiophene in antistatic primers has been disclosed in U.S. Pat. No. 5,391,472. Use of sulfonated polyesters in conjunction with polypyrrole has been disclosed in U.S. Pat. Nos. 5,674,654 and 5,665,498. Use of sulfopolymers or polyesterionomers in conjunction with colloidal vanadium oxide has been disclosed in U.S. Pat. Nos. 5,360,706; 5,380,584; 5,427,835; 5,439,785; 5,576,163; and others. However, as demonstrated hereinbelow through comparative samples, such sulfonated polyesters or polyesterionomers resulted in inferior performance when compared to sulfonated polyurethanes in accordance with the present invention. Use of polyurethanes with hydrophilic properties, as a third component in antistatic primer layers containing polythiophene and sulfonated polyesters, has been additionally disclosed in U.S. Pat. No. 5,391,472. However, as demonstrated hereinbelow through comparative samples, not all polyurethanes with hydrophilic properties are compatible with electrically conducting polymers or colloidal vanadium oxide. In fact, the coating of a polythiophene-containing layer with a polyurethane binder and magnetic particles resulted in "insufficient antistatic effects", according to the disclosure of U.S. Pat. No. 5,443,944. Furthermore, the above indicated sulfonated polyesters and non-sulfonated hydrophilic polyurethanes were found to provide insufficient adhesion for an electrically-conductive layer overcoated with a transparent magnetic recording layer as disclosed in U.S. Pat. No. 5,718,995. Thus, the results obtained, in accordance with the present invention consisting of an electrically-conductive layer containing an electrically-conductive agent and a sulfonated polyurethane used in combination with a transparent magnetic recording layer are neither expected from nor taught by the disclosures of hereinabove mentioned U.S. patents.

The electrically-conductive agent can constitute about 0.1 to 80 volume percent of the conductive layer of this invention. The amount of electrically-conductive agent contained in the conductive layer is defined in terms of volume percent rather than weight percent since the densities of the various suitable conductive agents vary widely. Suitable volume percents for obtaining useful electrical conductivities depend to a large extent on the volume resistivity and morphology of the conductive agent in addition to the specific imaging application. For acicular antimony-doped tin oxide particles described hereinabove, suitable volume percents range from about 2 to 70 volume percent, which correspond to tin oxide particle to sulfonated polyurethane binder weight ratios of from approximately 1:9 to 19:1. For granular antimony-doped tin oxide or zinc antimonate particles described hereinabove, suitable volume percents range from about 20 to 80 volume percent; which correspond to conductive particle to sulfonated polyurethane binder weight ratios of from approximately 3:2 to 25:1. For colloidal vanadium oxide, suitable volume percents range from about 0.1 to 30 volume percent, which correspond to colloidal vanadium oxide to sulfonated polyurethane binder weight ratios of from approximately 1:500 to 4:1. For electrically-conductive polymers suitable volume percents range from about 5 to 80 volume percent.

Optional polymeric film-forming cobinders suitable for use in conductive layers of this invention include: water-soluble, hydrophilic polymers such as gelatin, gelatin derivatives, maleic acid anhydride copolymers such as sulfonated styrene/maleic acid anhydride; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable cobinders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of non-sulfonated polyurethanes or polyesterionomers. Gelatin and gelatin derivatives, non-sulfonated polyurethanes, polyesterionomers, sulfonated styrene/maleic anhydride copolymers, and aqueous emulsions of vinylidene halide interpolymers are the preferred cobinders.

Solvents useful for preparing dispersions and coatings containing an electrically-conductive agent by the method of this invention include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; ethylene glycol, and mixtures thereof. Preferred solvents include water, alcohols, and acetone.

In addition to binders and solvents, other components that are well known in the photographic art also can be included in the conductive layer of this invention. Other addenda, such as matting agents, surfactants or coating aids, charge control agents, polymer lattices to improve dimensional stability, thickeners or viscosity modifiers, hardeners or cross-linking agents, soluble antistatic agents, soluble and/or solid particle dyes, antifoggants, lubricating agents, and various other conventional additives optionally can be present in any or all of the layers of the multilayer imaging element.

Dispersion of an electrically-conductive agent in suitable liquid vehicles can be formulated with a sulfonated polyurethane film-forming binder and various addenda and applied to a variety of supports to form electrically-conductive layers of this invention. Typical photographic film supports include: cellulose nitrate, cellulose acetate, cellulose acetate butyrate, cellulose acetate propionate, poly (vinyl acetal), poly(carbonate), poly(styrene), poly(ethylene terephthalate), poly(ethylene naphthalate) or poly(ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Supports can be either transparent or opaque depending upon the application. Transparent film supports can be either colorless or colored by the addition of a dye or pigment. Film supports can be surface-treated by various processes including corona discharge, glow discharge, UV exposure, flame treatment, electron-beam treatment, as described in U.S. Pat. No. 5,718,995; treatment with adhesion-promoting agents including dichloro- and trichloroacetic acid, phenol derivatives such as resorcinol, 4-chloro-3-methyl phenol, and p-chloro-m-cresol; and solvent washing or can be overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like. Other suitable opaque or reflective supports are paper, polymer-coated paper, including polyethylene-, polypropylene-, and ethylene-butylene copolymer-coated or laminated paper, synthetic papers, pigment-containing polyesters, and the like. Of these supports, films of cellulose triacetate, poly (ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m) are suitable for photographic elements in accordance with this invention.

Dispersions containing an electrically-conductive agent, a sulfonated polyurethane film-forming binder, and various additives in a suitable liquid vehicle can be applied to the aforementioned film or paper supports using any of a variety of well-known coating methods. Handcoating techniques include using a coating rod or knife or a doctor blade. Machine coating methods include air knife coating, reverse roll coating, gravure coating, curtain coating, bead coating, slide hopper coating, extrusion coating, spin coating and the like, as well as other coating methods known in the art.

The electrically-conductive layer of this invention can be applied to the support at any suitable coverage depending on the specific requirements of a particular type of imaging element. For example, for silver halide photographic films, dry coating weights of the conductive layer are preferably in the range of from about 0.002 to 2 g/m$^2$. More preferred dry weight coverages are in the range of about 0.005 to 1 g/m$^2$. The conductive layer of this invention typically exhibits a surface resistivity (20% RH, 20° C.) of less than 1×10 ohms/square, preferably less than $1\times10^9$ ohms/square, and more preferably less than $1\times10^8$ ohms/square.

Imaging elements having a transparent magnetic recording layer are well known in the imaging art as described hereinabove. Such a transparent magnetic recording layer contains a polymeric film-forming binder, ferromagnetic particles, and other optional addenda for improved manufacturabilty or performance such as dispersants, coating aids, fluorinated surfactants, crosslinking agents or hardeners, catalysts, charge control agents, lubricants, abrasive particles, filler particles, and the like.

Suitable ferromagnetic particles include ferromagnetic iron oxides, such as: $\gamma$-$Fe_2O_3$, $Fe_3O_4$; $\gamma$-$Fe_2O_3$ or $Fe_3O_4$ bulk doped or surface-treated with Co, Zn, Ni or other metals; ferromagnetic chromium dioxides such as $CrO_2$ or $CrO_2$ doped with Li, Na, Sn, Pb, Fe, Co, Ni, Zn or halogen atoms in solid solution; ferromagnetic transition metal ferrites; ferromagnetic hexagonal ferrites, such as barium and strontium ferrite; ferromagnetic metal alloys with oxide coatings on their surface to improve chemical stability and/or dispersibility. In addition, ferromagnetic oxides with a shell of a lower refractive index particulate inorganic material or a polymeric material with a lower optical scattering cross-section as taught in U.S. Pat. Nos. 5,217,804 and 5,252,444 may be used. The ferromagnetic particles can exhibit a variety of sizes, shapes and aspect ratios. The preferred ferromagnetic particles for use in magnetic layers used in combination with the conductive layers of this invention are cobalt surface-treated $\gamma$-iron oxide with a specific surface area greater than 30 m$^2$/g.

As taught in U.S. Pat. No. 3,782,947, whether an element is useful for both photographic and magnetic recording depends both on the size distribution and the concentration of the ferromagnetic particles and on the relationship between the granularities of the magnetic and photographic layers. Generally, the coarser the grain of the silver halide emulsion in the photographic element containing a magnetic recording layer, the larger the mean size of the magnetic particles which are suitable. A magnetic particle coverage for the magnetic layer of from about 10 to 1000 mg/m$^2$, when uniformly distributed across the imaging area of a photographic imaging element, provides a magnetic layer that is suitably transparent to be useful for photographic imaging applications for particles with a maximum dimension of less than about 1 $\mu$m. Magnetic particle coverages less than about 10 mg/m$^2$ tend to be insufficient for magnetic recording purposes. Magnetic particle coverages greater than about 1000 mg/m$^2$ tend to produce magnetic layers with optical densities too high for photographic imaging. Particularly useful particle coverages are in the range of 20 to 70 mg/m$^2$. Coverages of about 20 mg/m$^2$ are particularly useful in magnetic layers for reversal films and coverages of about 40 mg/m$^2$ are particularly useful in magnetic layers for negative films. Magnetic particle concentrations in the coated layers of from about $1\times10^{-11}$ mg/$\mu$m$^3$ to $1\times10^{-10}$ mg/$\mu$m$^3$ are particularly preferred for transparent magnetic layers prepared for use in accordance with this invention.

Suitable polymeric binders for use in the magnetic layer include, for example: vinyl chloride-based copolymers such as, vinyl chloride-vinyl acetate copolymers, vinyl chloride-vinyl acetate-vinyl alcohol terpolymers, vinyl chloride-vinyl acetate-maleic acid terpolymers, vinyl chloride-vinylidene chloride copolymers, vinyl chloride-acrylonitrile copolymers; acrylic ester-acrylonitrile copolymers, acrylic ester-vinylidene chloride copolymers, methacrylic ester-vinylidene chloride copolymers, methacrylic ester-styrene copolymers, thermoplastic polyurethane resins, phenoxy resins, polyvinyl fluoride, vinylidene chloride-acrylonitrile copolymers, butadiene-acrylonitrile copolymers, acrylonitrile-butadiene-acrylic acid terpolymers, acrylonitrile-butadiene-methacrylic acid terpolymers, polyvinyl butyral, polyvinyl acetal, cellulose derivatives such as cellulose esters including cellulose acetate, cellulose diacetate, cellulose triacetate, cellulose acetate butyrate, cellulose acetate propionate, and the like; styrene-butadiene copolymers, polyester resins, phenolic resins, thermosetting polyurethane resins, melamine resins, alkyl resins, urea-formaldehyde resins, and the like.

The transparent magnetic layer can be positioned in an imaging element in any of various positions. For example, it can overlie one or more image-forming layers, or underlie one or more image forming layers, or be interposed between image-forming layers, or serve as a subbing layer for an image-forming layer, or be coated on the side of the support opposite to an image-forming layer. In a silver halide photographic element, the transparent magnetic layer is preferably on the side of the support opposite the silver halide emulsion.

Conductive layers of this invention can be incorporated into multilayer imaging elements in any of various configurations depending upon the requirements of the specific imaging element. The conductive layer may be present as a subbing or tie layer underlying the magnetic recording layer or as a topcoat layer overlying the magnetic layer on the side of the support opposite the imaging layer(s). Conductive layers also may be located on the same side of the support as the imaging layer(s) or on both sides of the support. When a conductive layer containing acicular metal-containing particles is applied as a subbing layer under a sensitized emulsion layer, it is not necessary to apply any intermediate layers such as barrier layers or adhesion promoting layers between it and the sensitized emulsion layer, although they can optionally be present. A conductive subbing layer also can be applied either under or over a gelatin subbing layer containing an antihalation dye or pigment. Alternatively, both antihalation and antistatic functions can be combined in a single layer containing conductive particles, antihalation dye, and a binder. This hybrid layer is typically coated on the same side of the support as the sensitized emulsion layer. Additional optional layers can be present as well. The conductive layer of this invention also can be used as the outermost layer of an imaging element, for example, as a protective layer overlying an image-forming layer. When the conductive layer of this invention is applied over a sensitized emulsion layer, it is not necessary to apply any intermediate layers such as barrier or adhesion-promoting layers between the conductive overcoat layer and the imaging layer(s), although they can optionally be present. The conductive layer of this invention is preferably located on the same side of the support as the magnetic layer. However, the function of a conductive layer may be incorporated into the magnetic layer as described in U.S. Pat. Nos. 5,427,900 and 5,459,021 for granular conductive particles. Other addenda, such as polymer lattices to improve dimensional stability, hardeners or cross-linking agents, surfactants, matting agents, lubricants, and various other well-known additives can be present in any or all of the above mentioned layers.

Conductive layers of this invention underlying a transparent magnetic recording layer typically exhibit an internal resistivity (wet electrode resistivity) of less than $1\times10^{11}$ ohm/square, preferably less than $1\times10^{10}$ ohm/square, and more preferably, less than $1\times10^{9}$ ohm/square after overcoating with the transparent recording layer.

In a particularly preferred embodiment, imaging elements of this invention are photographic elements, which can differ widely in structure and composition. For example, said photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially examples 16 and 21, are particularly suitable. Any of the known silver halide emulsion layers, such as those described in *Research Disclosure,* Vol. 176, Item 17643 (December, 1978) and *Research Disclosure,* Vol. 225, Item 22534 (January, 1983), and *Research Disclosure,* Item 36544 (September, 1994), and *Research Disclosure,* Item 37038 (February, 1995) and the references cited therein are useful in preparing photographic elements in accordance with this invention. Generally, the photographic element is prepared by coating the film support on the side opposite the transparent magnetic recording layer with one or more layers containing a silver halide emulsion and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Imaging elements incorporating conductive layers in combination with transparent magnetic recording layers in accordance with this invention also can comprise additional layers including adhesion-promoting layers, lubricant or transport-controlling layers, hydrophobic barrier layers, antihalation layers, abrasion and scratch protection layers, and other special function layers. Imaging elements of this invention incorporating conductive layers containing acicular metal-containing conductive particles in combination with transparent magnetic recording layers, useful for specific imaging applications such as color negative films, color reversal films, black-and-white films, color and black-and-white papers, electrographic media, dielectric recording media, thermally processable imaging elements, thermal dye transfer recording media, laser ablation media, ink jet media and other imaging applications should be readily apparent to those skilled in photographic and other imaging arts.

The method of the present invention is illustrated by the following detailed examples of its practice. However, the scope of this invention is by no means limited to these illustrative examples.

EXAMPLE 1

An aqueous dispersion of polypyrrole/poly(styrene sulfonic acid), conductive polymer A, was prepared by oxidative polymerization of pyrrole in an aqueous solution in the presence of poly (styrene sulfonic acid) using ammonium persulfate as the oxidant, according to U.S. Pat. No. 5,674,654. An antistatic layer coating formulation composed of polypyrrole/poly(styrene sulfonic acid) dispersed in water with a sulfonated polyurethane aqueous dispersion, commercially available from Bayer Corporation under the trade name Bayhydrol PR 240, and a coating aid, Pluronic F88 (BASF Corporation) was prepared at nominally 4.1 wt %. The weight ratio of conductive polymer A to sulfonated polyurethane binder was nominally 30/70. The coating formulation is given below:

| Component | Weight % (wet) |
|---|---|
| Polyurethane dispersion (Bayhydrol PR 240 Bayer Corp.) | 2.80% |
| Wetting aid (Pluronic F88 BASF Corp.) | 0.10% |
| Polypyrrole/poly(styrene sulfonic acid) | 1.20% |
| Water | 95.90% |

The above coating formulation was applied to a moving 4 mil polyethylene naphthalate support using a coating hopper so as to provide nominal total dry coverages of 325 and 650 mg/m$^2$ for Examples 1a and 1b, respectively. The support had been coated previously with a typical subbing layer containing a vinylidene chloride-based terpolymer latex.

The resulting conductive layers were overcoated with a transparent magnetic recording layer as described in *Research Disclosure,* Item 34390, November, 1992. The transparent magnetic recording layer contains cobalt surface-modified $\gamma$-$Fe_2O_3$ particles in a polymeric binder which optionally may be cross-linked and optionally may contain suitable abrasive particles. The polymeric binder is a blend of cellulose diacetate and cellulose triacetate. Total dry coverage of the magnetic layer was nominally 1.5 g/m$^2$. An optional lubricant-containing topcoat layer containing carnauba wax and a fluorinated surfactant as a wetting aid may be applied over the transparent magnetic recording layer to provide a nominal dry coverage of about 0.02 g/m$^2$. The resultant multilayer structure including an electrically-conductive antistatic layer overcoated with a transparent magnetic recording layer, an optional lubricant layer, and other optional layers is referred to herein as a "magnetic backing package." The magnetic backing packages prepared in accordance with this invention and the comparative examples were evaluated for antistatic layer performance, dry adhesion, wet adhesion, and optical and ultraviolet densities ($D_{min}$).

Antistatic performance of the magnetic backing packages was evaluated by measuring the internal electrical resistivity using a salt bridge wet electrode resistivity (WER) measurement technique (as described, for example, in "Resistivity Measurements on Buried Conductive Layers" by R. A. Elder, pages 251–254, 1990 *EOS/ESD Symposium Proceedings*). Typically, antistatic layers with WER values greater than about $1\times10^{12}$ ohm/square are considered to be ineffective at providing static protection for photographic imaging elements. WER values were also measured for samples of magnetic backing packages after photographic processing by the standard C-41 process.

Dry adhesion of the magnetic backing package was evaluated by scribing a small region of the coating with a razor blade. A piece of high-tack adhesive tape was placed over the scribed region and quickly removed multiple times. The number of times the adhesive tape could be removed without any coating removal is a qualitative measure of the dry adhesion. Wet adhesion was evaluated using a procedure which simulates wet processing of silver halide photographic elements. A one millimeter wide line was scribed into a sample of the magnetic backings package. The sample was then immersed in KODAK Flexicolor developer solution at 38° C. and allowed to soak for 3 minutes and 15 seconds. The test sample was removed from the heated developer solution and then immersed in another bath containing Flexicolor developer at about 25° C. and a rubber pad (approximately 3.5 cm dia.) loaded with a 900 g weight was rubbed vigorously back and forth across the sample in the direction perpendicular to the scribe line. The relative amount of additional material removed is a qualitative measure of the wet adhesion of the various layers. Total optical and ultraviolet densities ($D_{min}$) of the backings packages were measured using a X-Rite Model 361T B&W transmission densitometer at 650 and 380 nm, respectively. The contributions of the polymeric support and any optional primer layers to the optical and ultraviolet densities were subtracted from the total $D_{min}$ values to obtain $\Delta$ UV and $\Delta$ ortho $D_{min}$ values which correspond to the net contribution of the magnetic backing package to the total ultraviolet and optical densities. WER values, adhesion results, and net optical and ultraviolet densities for Examples 1a and 1b are given in Table 1.

EXAMPLE 2

An antistatic layer coating formulation composed of conductive polymer A dispersed in water with sulfonated polyurethane, Bayhydrol PR 240, and a coating aid was prepared at nominally 4.1 wt %. The weight ratio of conductive polymer A to sulfonated polyurethane binder was nominally 20/80. The coating formulation is given below:

| Component | Weight % (wet) |
|---|---|
| Polyurethane dispersion (Bayhydrol PR 240 Bayer Corp.) | 3.2% |
| Wetting aid (Pluronic F88 BASF Corp.) | 0.1% |
| Polypyrrole/poly(styrene sulfonic acid) | 0.8% |
| Water | 95.9% |

The above coating formulation was applied to a moving 4 mil polyethylene naphthalate support using a coating hopper so as to provide nominal total dry coverages of 325 and 650 mg/m$^2$ for Examples 2a and 2b, respectively. The support had been coated previously with a typical subbing layer containing a vinylidene chloride-based terpolymer latex. The resulting conductive layers were overcoated with a transparent magnetic recording layer as described in Example 1. WER values, adhesion results, and net optical and ultraviolet densities for Examples 2 are given in Table 1.

EXAMPLE 3

An antistatic layer coating formulation composed of conductive polymer A dispersed in water with sulfonated polyurethane, Bayhydrol PR 240, an optional cobinder, AQ55D (Eastman Chemical Co.) and a coating aid was prepared at nominally 4.1 wt %. The weight ratio of conductive polymer A to cobinder to sulfonated polyurethane binder was nominally 30:15:55. The coating formulation is given below:

| Component | Weight % (wet) |
|---|---|
| Polyurethane dispersion (Bayhydrol PR 240 Bayer Corporation.) | 2.2% |
| Cobinder (AQ55D) | 0.6% |
| Wetting aid (Pluronic F88) | 0.1% |
| Conductive Polymer A | 1.2% |
| Water | 95.9% |

The above coating formulation was applied to a moving 4 mil polyethylene naphthalate support using a coating hopper so as to provide nominal total dry coverages of 325 and 650 mg/m$^2$ for Examples 3a and 3b, respectively. The support had been coated previously with a typical subbing layer containing a vinylidene chloride-based terpolymer latex. The resulting conductive layers were overcoated with a transparent magnetic recording layer as described in Example 1. WER values, adhesion results, and net optical and ultraviolet densities for Examples 2 are given in Table 1.

COMPARATIVE EXAMPLES 1–5

Antistatic coating formulations composed of Conductive Polymer A dispersed in water with a dipsersed polyurethane were prepared in a similar manner to Example 2, however, the polyurethane binder was not a sulfonated polyurethane according to the present invention. Comparative Example 1 used Bayhydrol 123, commercially available from Bayer Corporation, which contains neutralized carboxylic acid groups as the polyurethane solubilizing/dispersing groups, as recommended by U.S. Pat. No. 5,391,472 but are not sulfonated, as taught by the present invention. Comparative Examples 2–5, respectively, used Witcobond W-160, W-213, W-236, and W-320 all commercially available from Witco Corporation. Witcobond W-236 is an aliphatic, anionic polyurethane having an ultimate elongation to break of at least 350 percent as taught in U.S. Pat. No. 5,718,995 to be particularly useful in combination with a transparent magnetic recording layer and with energetic surface treatments. The antistatic coating formulations for Comparative Examples 1–5 resulted in coagulation, rendering them unsuitable for coating, indicating incompatibility of non-sulfonated polyurethane binders with electrically-conducting polypyrrole/poly(styrene sulfonic acid).

COMPARATIVE EXAMPLES 6–8

Antistatic layer coating formulations composed of Conductive Polymer A dispersed in water with a non-polyurethane film forming binder and optional coating aids, were prepared at nominally 2.0 weight percent solids. The film-forming polymeric binder for Comparative Example 6 was a polyesterionomer, AQ55D, commercially available from Eastman Chemical Company and taught for conductive layers containing polypyrroles in U.S. Pat. Nos. 5,665,498 and 5,674,654. Comparative Example 7 used a film-forming terpolymer latex consisting of n-butylmethacrylate, styrene and methacrlyloyloxyethyl-sulfonic acid. Comparative Example 8 used an acrylic copolymer emulsion, commercially available from Rohm and Haas under the tradename Rhoplex WL-51 as the film-forming binder. The weight ratio of conductive polymer A to polymeric binder was nominally 50:50. The antistatic coating formulations are given below:

| Component | Weight % (wet) |
|---|---|
| Polymeric Binder | 1.00% |
| Wetting aid | 0.10% |
| Conductive Polymer A | 1.00% |
| Water | 97.90% |

The above coating formulations were applied to a moving 4 mil polyethylene naphthalate support using a coating hopper so as to provide a nominal total dry coverage of 325 mg/m$^2$. The support had been coated previously with a typical subbing layer containing a vinylidene chloride-based terpolymer latex. The resulting conductive layers were overcoated with a transparent magnetic recording layer as described in Example 1. WER values, adhesion results, and net optical and ultraviolet densities are given in Table 1

TABLE 1

| Sample | Cond. Polymer A/ binder | coverage mg/m$^2$ | Raw WER log Ω/sq | Proc. WER log Ω/sq | Dry adh | wet adh | Δ UV D min | Δ ortho D min |
|---|---|---|---|---|---|---|---|---|
| Ex. 1a | 30/70 | 325 | 7.7 | 8.1 | excellent | good | 0.242 | 0.136 |
| Ex. 1b | 30/70 | 650 | 7.5 | 7.9 | excellent | good | 0.315 | 0.212 |
| Ex. 2a | 20/80 | 325 | 8.8 | 8.3 | excellent | good | 0.224 | 0.117 |
| Ex. 2b | 20/80 | 650 | 8.2 | 8.8 | excellent | excellent | 0.280 | 0.176 |
| Ex. 3a | 30/15/55 | 325 | 7.8 | 8.1 | excellent | very good | 0.251 | 0.146 |
| Ex. 3b | 30/15/55 | 650 | 7.7 | 8.3 | excellent | good | 0.319 | 0.219 |
| C-Ex. 1 | 20/80 | * | * | * | * | * | * | * |
| C-Ex. 2 | 20/80 | * | * | * | * | * | * | * |
| C-Ex. 3 | 20/80 | * | * | * | * | * | * | * |
| C-Ex. 4 | 20/80 | * | * | * | * | * | * | * |
| C-Ex. 5 | 20/80 | * | * | * | * | * | * | * |
| C-Ex. 6 | 50/50 | 325 | 9.0 | not measured | very poor | very good | 0.446 | 0.230 |
| C-Ex. 7 | 50/50 | 325 | 8.7 | not measured | very poor | good | 0.437 | 0.232 |
| C-Ex. 8 | 50/50 | 325 | 8.5 | not measured | very poor | very good | 0.452 | 0.236 |

*Could not coat due to poor solution stability

The above results demonstrate that sulfonated polyurethane binders of the present invention can be used in combination with an electrically conductive polymer such as polypyrrole to provide an effective antistatic layer in a magnetic backings package. Non-sulfonated polyurethanes, conversely, were incompatible with the polypyrrole/poly (styrene sulfonic acid) dispersion. Comparative Examples 6–8 demonstrate a variety of film-forming binders which are compatible with polypyrrole/poly(styrene sulfonic acid) and can give coated layers having good antistatic properties with good adhesion to the subbed polyester supports. However, when overcoated with a transparent magnetic recording layer, adhesion of the magnetic layer was unacceptable. Furthermore, the net UV Dmin and ortho Dmin values are unacceptably high for most photographic applications. Examples 1–3 demonstrate a dramatic improvement in both WER and dry adhesion of the magnetic backing package relative to Comparative Examples 6–8. Furthermore, similar internal resistivities can be achieved for prior art electrically-conductive layers containing polypyrrole and a polymeric binder which is not a sulfonated polyurethane and for electrically-conductive layers according to the present invention containing a sulfonated polyurethane and about 50% of the polypyrrole required for prior art layers. The use of substantially less polypyrrole in the present invention results in dramatically improved transparency as demonstrated by a reduction in net UV Dmin values from greater than 0.400 for Comparative Examples 6–8 to less than 0.250 for Examples 1a and 2a at equivalent nominal total dry coverages.

EXAMPLES 4 AND 5

Antistatic layer coating formulations composed of antimony-doped tin oxide dispersed in water with sulfonated polyurethane Bayhydrol PR 240 and a coating aid was prepared at nominally 3.5 weight percent solids. Example 4 used a granular antimony doped tin oxide dispersion commercially available under the tradename "SN100D" from Ishihara Sangyo Kaisha Ltd. Examples 5 used an acicular tin oxide dispersion available under the tradename "FS-10D" from Ishihara Techno Corporation. The weight ratio of conductive tin oxide to sulfonated polyurethane binder was nominally 70/30. The coating formulations are given below:

| Component | Weight % (wet) |
|---|---|
| Polyurethane dispersion (Bayhydrol PR 240 Bayer Corp.) | 1.019% |
| Wetting aid (Pluronic F88 BASF Corp.) | 0.100% |
| Tin oxide | 2.378% |
| Water | 99.503% |

The above coating formulations were applied to a moving 4 mil polyethylene naphthalate support using a coating hopper so as to provide nominal total dry coverages indicated in Table 2. The support had been coated previously with a typical subbing layer containing a vinylidene chloride-based terpolymer latex. The resulting conductive layers were overcoated with a transparent magnetic recording layer as described in Example 1. WER values, adhesion results, and net optical and ultraviolet densities are given in Table 2

EXAMPLE 6

An antistatic layer coating formulation composed of acicular tin oxide dispersed in water with sulfonated polyurethane Bayhydrol PR 240 and a coating aid was prepared at nominally 3.6 weight percent solids. The weight ratio of conductive tin oxide to sulfonated polyurethane binder was nominally 50/50. The coating formulation is given below:

| Component | Weight % (wet) |
|---|---|
| Polyurethane dispersion (Bayhydrol PR 240 Bayer Corp.) | 1.755% |
| Wetting aid (Pluronic F88 BASF Corp.) | 0.100% |
| Acicular tin oxide* | 1.755% |
| Water | 96.390% |

*FS10D, Ishihara Techno Corp.

The above coating formulation was applied to a moving 4 mil polyethylene naphthalate support using a coating hopper so as to provide a nominal total dry coverage of 1075 mg/m$^2$. The support had been surface treated by a corona discharge treatment immediately prior to coating the antistatic coating formulation. The resulting conductive layer was overcoated with a transparent magnetic recording layer as described in Example 1. WER values, adhesion results, and net optical and ultraviolet densities are given in Table 2.

TABLE 2

| Sample | $SnO_2$/binder | covg. mg/m$^2$ | WER log Ω/sq | Dry adh | wet adh | Δ UV D min | Δ ortho D min |
|---|---|---|---|---|---|---|---|
| Ex. 4a | 70/30 | 325 | 8.8 | excellent | excellent | 0.173 | 0.062 |
| Ex. 4b | 70/30 | 1075 | 7.7 | excellent | excellent | 0.179 | 0.067 |
| Ex. 5a | 70/30 | 325 | 8.0 | excellent | excellent | 0.169 | 0.061 |
| Ex. 5b | 70/30 | 650 | 7.3 | excellent | excellent | 0.180 | 0.068 |
| Ex. 6 | 50/50 | 1075 | 7.9 | excellent | excellent | 0.160 | 0.053 |

Examples 4–6 demonstrate that magnetic backing packages consisting of a transparent magnetic recording layer overlying an electrically-conductive layer containing a sulfonated polyurethane binder and tin oxide have excellent adhesion and conductivity. Example 6, further demonstrates excellent adhesion to surface treated polyester supports in addition to subbed polyester supports.

EXAMPLE 7

An antistatic layer coating formulation composed of colloidal vanadium oxide dispersed in water with a sulfonated polyurethane Bayhydrol PR 240, and a coating aid was prepared at nominally 0.40 weight percent solids. The colloidal vanadium oxide was prepared by the melt-quenching technique as taught by Guestaux in U.S. Pat. No. 4,203,769. The weight ratio of colloidal vanadium oxide to sulfonated polyurethane binder was nominally 1/4. The coating formulation is given below:

| Component | Weight % (wet) |
|---|---|
| Polyurethane dispersion (Bayhydrol PR 240 Bayer Corp.) | 0.239% |
| Wetting aid (Pluronic F88, BASF Corp.) | 0.100% |
| Colloidal vanadium oxide | 0.060% |
| Water | 99.601% |

The above coating formulation was applied to a moving 4 mil polyethylene naphthalate support using a coating hopper so as to provide nominal total dry coverages of 45 and 90 mg/m$^2$. The support had been coated previously with a typical subbing layer containing a vinylidene chloride-based terpolymer latex. The resulting conductive layer was overcoated with a transparent magnetic recording layer as described in Example 1. WER values, adhesion results, and net optical and ultraviolet densities for Examples 4 are given in Table 3.

COMPARATIVE EXAMPLE 9

An antistatic layer coating formulation composed of colloidal vanadium oxide dispersed in water with a dispersed sulfopolyester binder as taught in U.S. Pat. No. 5,427,835 was prepared at nominally 0.6 weight percent. The sulfopolyester used was commercially available from Eastman Chemical Company under the trade name, AQ29D. A coating aid of Triton X-100 surfactant (Rohm and Haas) was used. The colloidal vanadium oxide was prepared by the melt-quenching technique as taught by Guestaux in U.S. Pat. No. 4,203,769. The weight ratio of colloidal vanadium oxide to sulfonated polyurethane binder was nominally 1/22. The coating formulation is given below:

| Component | Weight % (wet) |
|---|---|
| Polymeric binder (AQ29D) | 0.571% |
| Wetting aid (Triton X-100) | 0.026% |
| Colloidal vanadium oxide | 0.026% |
| Water | 99.377% |

The above coating formulation was applied to a moving 4 mil polyethylene naphthalate support using a coating hopper so as to provide a nominal total dry coverage of 110 mg/m$^2$. The support had been surface treated by either nitrogen glow discharge treatment (Comparative Example 9a) or oxygen glow discharge treatment (Comparative Example 9b) prior to coating. The resulting conductive layers were overcoated with a transparent magnetic recording layer as described in Example 1. WER values and adhesion results for Comparative Examples 9 are given in Table 3. Additional samples with ratios of colloidal vanadium oxide to AQ29D of 1/1 and 1/11 were also evaluated, however, all samples had very poor dry adhesion when overcoated with a transparent magnetic recording layer.

COMPARATIVE EXAMPLE 10

An antistatic layer coating formulation composed of colloidal vanadium oxide dispersed in water with an anionic, aliphatic polyurethane binder having an ultimate elongation to break of at least 350 percent as taught in U.S. Pat. No. 5,718,995 was prepared at nominally 0.2 weight percent. The polyurethane used was commercially available from Witco Corporation under the trade name, Witco W-236. A coating aid of Triton X-100 surfactant (Rohm and Haas) was used. The colloidal vanadium oxide was prepared by the melt-quenching technique as taught by Guestaux in U.S. Pat. No. 4,203,769. The weight ratio of colloidal vanadium oxide to sulfonated polyurethane binder was nominally 1/4. The coating formulation is given below:

| Component | Weight % (wet) |
|---|---|
| Polymeric binder (W-236) | 0.133% |
| Wetting aid (Triton X-100) | 0.033% |
| Colloidal vanadium oxide | 0.033% |
| Water | 99.801% |

The above coating formulation was applied to a moving 4 mil polyethylene naphthalate support using a coating hopper so as to provide a nominal total dry coverage of 45 mg/m$^2$. The support had been surface treated by oxygen glow discharge treatment prior to coating. The resulting conductive layer was overcoated with a transparent magnetic recording layer as described in Example 1. WER values and adhesion results are given in Table 3.

COMPARATIVE EXAMPLES 11–13

Antistatic layer coating formulations composed of colloidal vanadium oxide dispersed in water with an non-sulfonated polyurethane binders were prepared at nominally 0.075 weight percent. The polyurethane binders for Comparative Examples 11–13 were respectively, Witcobond W-213 and Witcobond W-252, commercially available from Witco Corporation, and Sancure 843, commercially available from B. F. Goodrich. A coating aid of Triton X-100 surfactant (Rohm and Haas) was used. The colloidal vanadium oxide was prepared by the melt-quenching technique as taught by Guestaux in U.S. Pat. No. 4,203,769. The weight ratio of colloidal vanadium oxide to sulfonated polyurethane binder was nominally 1/1. The coating formulation is given below:

| Component | Weight % (wet) |
|---|---|
| Polyurethane binder | 0.025% |
| Wetting aid (Triton X-100) | 0.025% |
| Colloidal vanadium oxide | 0.025% |
| Water | 99.925% |

Antistatic coating formulations containing either Witcobond W-213 or Witcobond W-252 in combination with colloidal vanadium oxide were not stable, resulting in coagulation or precipitation and were not coated. The coating formulation of Comparative Example 13, containing Sancure 843 polyurethane binder was applied to a nitrogen glow discharge treated polyethylene naphthalate supports so as to provide a nominal total dry coverage of 110 mg/m$^2$. Dry adhesion of the antistatic layer was excellent. Surface electrical resistivity (SER) of the antistatic layer was measured with a Kiethley Model 616 digital electrometer using a two point DC probe by a method similar to that described in U.S. Pat. No. 2,801,191. The SER value was greater than 13 log ohm/sq. and considered not be effective as an antistatic layer and consequently not evaluated further.

TABLE 3

| Sample | $V_2O_5$/ binder | covg. mg/ m$^2$ | WER log Ω/sq | Dry adh | wet adh | Δ UV D min | Δ ortho D min |
|---|---|---|---|---|---|---|---|
| Ex. 7a | 1/4 | 45 | 7.8 | excellent | good | 0.186 | 0.063 |
| Ex. 7b | 1/4 | 90 | 7.0 | excellent | good | 0.212 | 0.066 |
| C-Ex. 9a | 1/22 | 110 | 7.3 | very poor | poor | N.M. | N.M. |
| C-Ex. 9b | 1/22 | 110 | 7.1 | good | fair | N.M. | N.M. |
| C-Ex. 10 | 1/4 | 45 | 6.8 | poor | poor | N.M. | N.M. |
| C-Ex. 11 | 1/1 | * | * | * | * | * | * |
| C-Ex. 12 | 1/1 | * | * | * | * | * | * |
| C-Ex. 13 | 1/1 | 10 | >13$^+$ | excellent$^+$ | N.M. | N.M. | N.M. |

*Could not coat due to poor solution stability
$^+$SER and dry adhesion of antistatic layer prior to coating of magnetic layer. N.M. Not measured The above examples demonstrate the improved solution stability of coating formulations comprised of a sulfopolyurethane and colloidal vanadium oxide relative to a variety of other polyurethane binders. Furthermore, electrically-conductive layers containing a sulfopolyurethane and colloidal vanadium oxide provide improved adhesion to polyester supports and of an overlying transparent magnetic recording layer than prior art electrically-conductive layers containing colloidal vanadium oxide and either a non-sulfonated polyurethane binder or a sulfopolyester binder. In particular, Examples 7a and 7b having a sulfonated polyurethane binder have dramatically improved adhesion relative to Comparative Examples 9a and 9b of the present application having a significantly greater fraction of a sulfopolyester binder taught as a preferred binder in U.S. Pat. No. 5,427,835.

EXAMPLE 8

An antistatic layer coating formulation composed of zinc antimonate dispersed in water with sulfonated polyurethane Bayhydrol PR 240 and a coating aid was prepared at nominally 3.5 weight percent solids. The weight ratio of zinc antimonate to sulfonated polyurethane binder was nominally 70/30. The coating formulation is given below:

| Component | Weight % (wet) |
|---|---|
| Polyurethane dispersion (Bayhydrol PR 240 Bayer Corp.) | 1.019% |
| Wetting aid (Pluronic F88 BASF Corp.) | 0.100% |
| Zinc antimonate* | 2.378% |
| Water | 99.503% |

*Celnax CX-Z, Nissan Chemical America, Inc.

The above coating formulation was applied to a moving 4 mil polyethylene naphthalate support using a coating hopper so as to provide a nominal total dry coverage of 1075 $mg/m^2$. The support had been coated previously with a typical subbing layer containing a vinylidene chloride-based terpolymer latex. The resulting conductive layers were overcoated with a transparent magnetic recording layer as described in Example 1. The internal resistivity for the electrically-conductive layer after overcoating with a transparent magnetic recording layer was 7.9 log ohm/sq. Dry adhesion and wet adhesion for the magnetic backing package were both excellent (viz. no removal).

The above examples clearly demonstrate that the sulfonated polyurethane film-forming binder of the present invention provides improved adhesion of an electrically-conductive layer to an underlying support and to an overlying transparent magnetic recording layer. Furthermore, the sulfonated polyurethane binder provides coating formulations having improved stability or compatibility with a wide variety of electrically-conductive agents. In particular, stability is greatly improved for electrically-conductive polymers such as poly(pyrrole)/poly(styrene sulfonic acid) and for conductive colloidal gels such as colloidal vanadium oxide relative to similar coating formulations containing a non-sulfonated polyurethane binder. A further advantage, particularly for electrically-conductive polymers is an improved internal resistivity which allows a reduction in the conductive polymer to sulfonated polyurethane binder ratio which can result in improved adhesion and transparency of a magnetic backing package.

The invention has been described in detail with particular reference to certain preferred embodiments thereof, but it will be understood that variations and modifications can be effected within the spirit and scope of the invention.

What is claimed is:

1. An imaging element comprising:

a support;

at least one image-forming layer superposed on the support;

at least one transparent magnetic recording layer superposed on the support;

an electrically-conductive layer superposed on the support;

said electrically-conductive layer comprising a sulfonated polyurethane film-forming binder and an electrically-conductive polymer;

wherein the electrically-conductive polymer comprises substituted aniline-containing polymers, unsubstituted aniline-containing polymers, substituted thiophene-containing polymers, unsubstituted thiophene-containing polymers, substituted pyrrole-containing polymers, unsubstituted pyrrole-containing polymers, or poly(isothianaphthene).

2. An imaging element according to claim 1, wherein the internal resistivity of said electrically-conductive layer is less than $1\times10^{11}$ ohm/square.

3. The imaging element of claim 1, wherein the electrically-conductive polymer comprises a 0.1 to 80 volume percent of said electrically-conductive layer.

4. The imaging element of claim 1, wherein said electrically-conductive layer comprises a dry weight coverage of from 2 to 2000 $mg/m^2$.

5. The imaging element of claim 1, wherein said electrically-conductive layer has a surface resistivity of less than $1\times10^{10}$ ohms per square.

6. The imaging element of claim 1, wherein the electrically-conductive layer further comprises matting agents, surfactants, coating aids, charge control agents, polymer lattices, viscosity modifiers, hardeners, soluble antistatic agents, particle dyes, antifoggants or lubricating agents.

7. The imaging element of claim 1, wherein said support comprises cellulose nitrate, cellulose acetate, cellulose acetate butyrate, cellulose acetate propionate, poly(vinyl acetal), poly(carbonate), poly(styrene), poly(ethylene terephthalate) or poly(ethylene naphthalate).

8. The imaging element of claim 1, wherein the transparent magnetic recording layer comprises cobalt surface modified γ-iron oxide particles.

9. The imaging element of claim 8, wherein the cobalt surface modified γ-iron oxide particles comprise a dry weight coverage of from 10 $mg/m^2$ to 1000 $mg/m^2$.

10. The imaging element of claim 1, wherein the transparent magnetic recording layer comprises a film-forming binder selected from the group consisting of cellulose diacetate, cellulose triacetate and polyurethane.

11. The imaging element of claim 1, wherein the sulfonated polyurethane film-forming binder comprises an anionic aliphatic sulfonated polyurethane.

12. A photographic film comprising:

(1) a support;

(2) a silver halide emulsion layer on a side of said support;

(3) a transparent magnetic recording layer on an opposite side of said support; said transparent magnetic recording layer comprising ferromagnetic particles dispersed in a film-forming polymeric binder; and (4) an electrically-conductive layer underlying said transparent magnetic recording layer; said electrically-conductive layer comprising a sulfonated polyurethane film-forming binder and an electrically-conductive polymer selected from the group consisting of aniline-containing polymers, substituted aniline-containing polymers, thiophene-containing polymers, substituted thiophene-containing polymers, pyrrole-containing polymers, and substituted pyrrole-containing polymers.

13. A photographic element according to claim 12, wherein said sulfonated polyurethane film-forming binder is poly(3,4-ethylene dioxypyrrole styrene sulfonate) or poly(3,4-ethylene dioxythiophene styrene sulfonate).

* * * * *